United States Patent [19]

Noritake et al.

[11] 4,353,873

[45] Oct. 12, 1982

[54] SUPPORT APPARATUS FOR CATALYST BLOCK

[75] Inventors: Yutaka Noritake, Kawagoe; Ikuo Kajitani, Hanno; Yutaka Hirayama, Kawagoe, all of Japan

[73] Assignee: Honda Giken Kogyo Kabushiki Kaisha, Tokyo, Japan

[21] Appl. No.: 257,265

[22] Filed: Apr. 24, 1981

[30] Foreign Application Priority Data

Apr. 30, 1980 [JP] Japan ..... 55-58272[U]

[51] Int. Cl.[3] ..... F01N 3/10

[52] U.S. Cl. ..... 422/179; 60/299; 422/177; 422/180

[58] Field of Search ..... 422/179, 180, 177; 60/299, 302

[56] References Cited

U.S. PATENT DOCUMENTS

| | | | |
|---|---|---|---|
| 3,854,888 | 12/1974 | Frietzsche et al. | 422/179 X |
| 4,004,888 | 1/1977 | Musall et al. | 422/179 |
| 4,043,761 | 8/1977 | Gaysert et al. | 422/179 |
| 4,101,280 | 7/1978 | Frietzsche et al. | 422/180 |
| 4,143,117 | 3/1979 | Gaysert | 422/179 |
| 4,163,041 | 7/1979 | Gaysert | 422/179 |
| 4,251,487 | 2/1981 | Goedicke | 422/179 |
| 4,279,864 | 7/1981 | Nara et al. | 422/179 |

FOREIGN PATENT DOCUMENTS

| | | | |
|---|---|---|---|
| 55-64111 | 5/1980 | Japan | 422/180 |

*Primary Examiner*—Richard L. Chiesa
*Attorney, Agent, or Firm*—Lyon & Lyon

[57] ABSTRACT

A device for supporting a cylindrical catalyst block includes a tubular cushion member mounted within a casing and encircling the catalyst block. An end member fixed within the casing carries an annular cushion. A ring is interposed between the annular cushion and the end face of the catalyst block. Interengaging parts are provided for preventing rotation of the ring with respect to the casing.

1 Claim, 20 Drawing Figures

SUPPORT APPARATUS FOR CATALYST BLOCK

This invention relates to an improved device for supporting a monolithic catalyst block. Typically, the catalyst block is contacted by exhaust gases from an internal combustion engine. Vibration from the engine or from the vehicle which the engine drives requires special mounting of the catalyst block because of its relatively fragile character. Moreover, the mounting must withstand the temperature changes which occur between the times when the engine is not running and times when it is operating under high load.

In accordance with this invention, the catalyst block is positioned within a tubular cushion mounted within a casing. An annular end member is fixed within the casing and carries an annular cushion. A thin ring is inerposed between the annular cushion and the end face of the catalyst block, and interengaging parts for preventing rotation of the ring are provided. The interengaging parts may comprise a projection or recess on the ring and a corresponding recess or projection on a stationary part such as the annular end member.

Other and more detailed objects and advantages will appear hereinafter.

Figure 1:
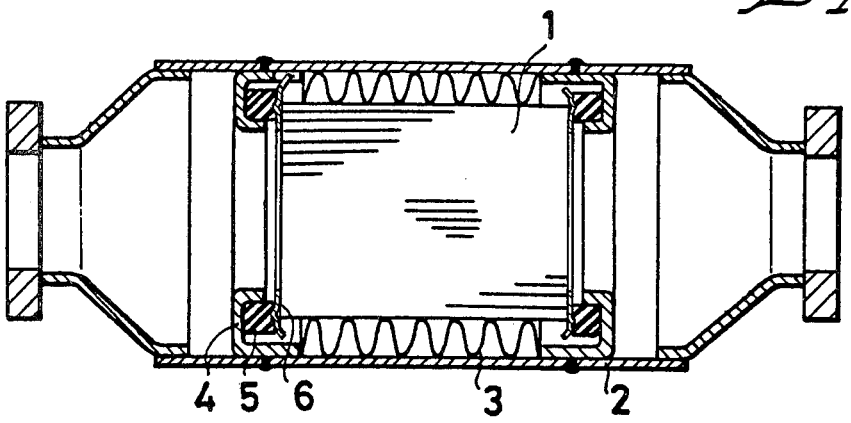
FIG. 1 is a longitudinal section of a carrier for supporting a catalyst block, constituting a preferred embodiment of this invention.
Figure 2:
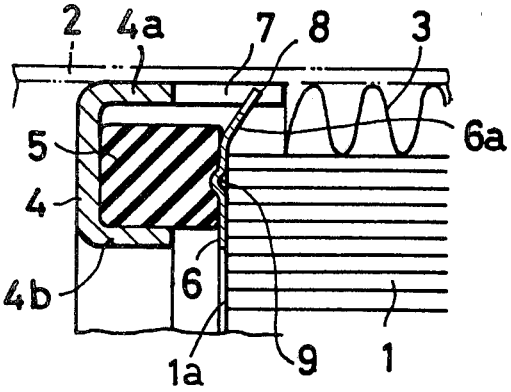
FIG. 2 is a sectional detail on an enlarged scale.
Figure 3:
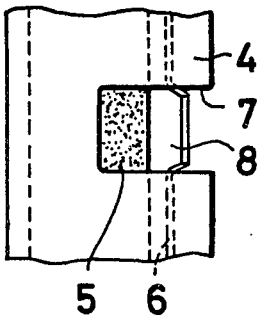
FIG. 3 is a plan view partly broken away, showing a portion of FIG. 2.

Referring to the drawings, the monolithic catalyst block 1 is cylindrical in shape with end surfaces in parallel planes at right angles to the cylindrical axis. As shown in FIGS. 1 and 2, the catalyst block 1 is supported directly within a tubular cushion 3 which has its outer peripheral surface disposed in contact with the inner peripheral surface of the casing 2 of the supporting device. At least one end of the catalyst block 1 is contacted by an annular cushion member 5 retained in place by an end member 4 mounted directly within and fixed to the casing 2. An annular locking ring 6 is positioned between an end face 1*a* of the catalyst block 1 and the annular cushion member 5.

With the construction described below, the locking ring 6 is prevented from becoming loose with respect to the catalyst block 1, when the supporting parts undergo elastic deterioration of the cusbion member 5, which may result from a long period of use under high temperature conditions, or thermal expansion of the casing 2. The locking ring 6 is prevented from rotating due to vibrations given to the catalyst block 1 or pulsation of exhaust gas flowing in an exhaust gas passage in which the supporting device is installed. Unwanted rotation of the locking ring 6 is accompanied by rubbing of the locking ring on the associated end face of the catalyst block 1, which causes unwanted abrasion of the end face. This end face 1*a* of the catalyst block 1 is adversely roughened after being subjected to such abrasion even for a short period of time. This results not only in the inability of the ring to retain the associated end of the catalyst block, but also in leakage of gas through the gap between the catalyst block 1 and the ring 6, leading to an early breakdown of the supporting device.

The present invention overcomes the above-mentioned disadvantage, and provides a supporting device having a simple construction which is capable of positively preventing the rotation of the ring 6 with no increase in the loads applied to the end faces of the catalyst block which is usually made of a fragile material, thereby to avoid wear of the catalyst block which would be caused by the rotation of the ring 6.

An end member 4 has a U-shaped cross section, which has an outer axial portion 4*a* secured to the casing 2, and an inner axial portion 4*b* serving to support an annular cushion member 5. The outer axial portion 4*a* of the end member 4 is formed with an engaging portion in the form of a notch 7 formed by partially cutting off the end edge of the portion 4*a*. A locking ring 6 has a diameter larger than that of the catalyst block 1. The outer peripheral edge of the ring 6, which is located radially outwardly with respect to the catalyst block 1, is formed as an inclined outer edge 6*a* so as to avoid application of a heavy load to the ring 6 caused by expansion of the annular cushion member 5. The ring 6 further includes an antirotation or locking portion 8 in the form of a tab or finger extending from the outer periphery of the inclined outer edge 6*a*, the locking portion 8 being engaged in the notch 7 of the end member 4 to keep the ring 6 from rotating.

The protuberance 9 serves as a dowel, which projects into the annular cushion member 5 for prevention of rotation of same. That is, this protuberance 9 serves to keep the member 5 from being rotated due to a drop in its restitution coefficient which is caused by its thermal fatigue after a long period of use or after use under high temperature conditions.

Figure 7:
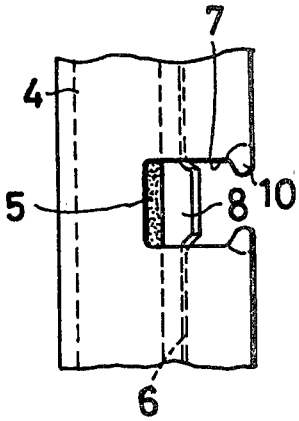
FIG. 7 is a view similar to FIG. 5, showing a further modification.
Figure 4:
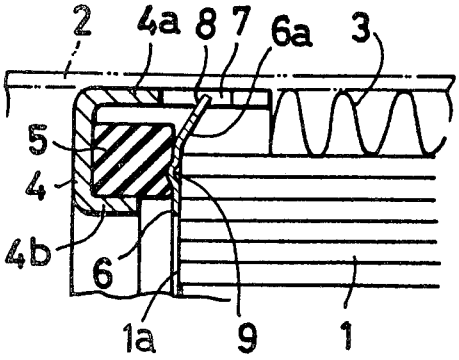
FIG. 4 is a view similar to FIG. 2, showing a modification.
Figure 5:
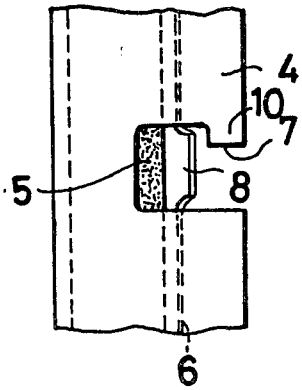
FIG. 5 is a plan view, partly broken away, of the device shown in FIG. 4.
Figure 6:
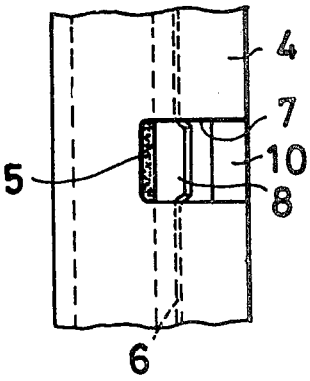
FIG. 6 is a view similar to FIG. 5, showing a modification.

FIGS. 4 and 5 illustrate another embodiment of the invention, in which the end member 4 also has a U-shaped cross section. The end member is provided with a projection 10 formed at the notch 7 for preventing the ring 6 from becoming disengaged from the notch 7 and struck against the associated end face of the catalyst block 1. The projection 10 may be formed in any optional form. For instance, the engaging notch 7 may be formed in the shape of a keyhole as seen in FIG. 5, or a separate piece 10 may be fitted in the opening of the notch 7 as seen in FIG. 6, or the opening in the notch 7 may have two oppositely arranged projections 10 as shown in FIG. 7. These projections can be formed by flattening out the peripheral edge of the opening of the notch 7 by means of a suitable tool.

Figure 8:
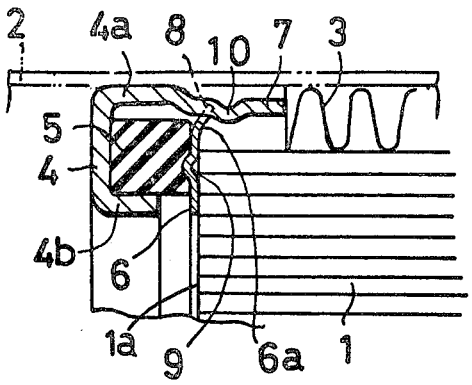
FIG. 8 is a sectional view similar to FIG. 3, showing a further modification.
Figure 9:
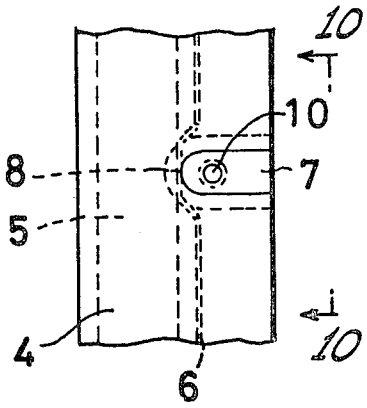
FIG. 9 is a plan view, partly broken away, of the device of FIG. 8.
Figure 10:
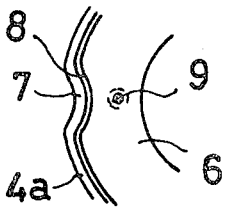
FIG. 10 is a detail taken substantially in the direction of lines 10—10 as shown in FIG. 9.

FIGS. 8, 9 and 10 illustrate a still further embodiment, in which the end member 4, which also has a U-shaped cross section, has its notch 7 formed as a depression extending radially inward with respect to the outer axial portion 4*a*, while the locking tab 8 of the ring 6 is formed as a U-shaped groove formed in part of the inclined outer edge 6*a*, which tab 8 engages the notch 7 of the end member 4. The notch 7 is also formed with a dowel-like protuberance 10 in engagement with the tab 8 to serve as a stopper.

Figure 11:
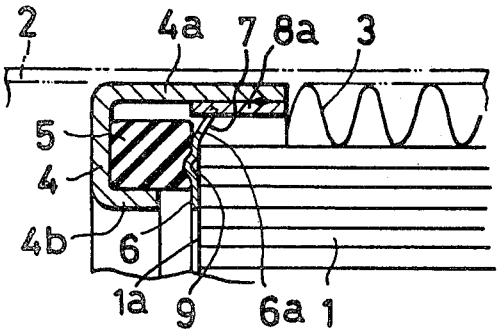
FIG. 11 is a sectional elevation similar to FIG. 8, showing another modification.
Figure 12:
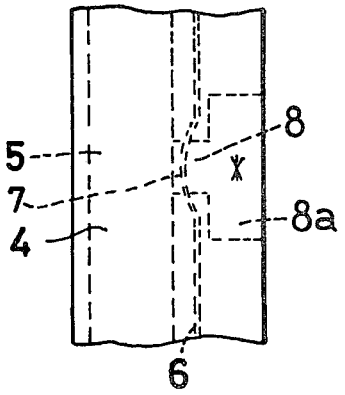
FIG. 12 is a plan view, partly broken away, of the device shown in FIG. 11.

FIGS. 11 and 12 illustrate another embodment of the invention in which the end member 4, which also has a U-shaped cross section, has a plate 8*a* which is welded to the inner surface of the outer axial portion 4*a*. A tab 8 on the plate 8*a* projects axially into a notch 7 formed in the slanted or frustro-conical portion 6*a* of the ring 6. The plate 8*a* comprises a portion of the end member 4. The axially projecting tab 8 on the plate 8*a* also serves as a stopper for limiting axial movement of the ring 6 to thereby prevent wear of the catalyst block 1, which would otherwise take place due to striking of the ring 6 against the associated end face 1*a* of the catalyst block 1 when the ring 6 is moved axially.

Figure 13:
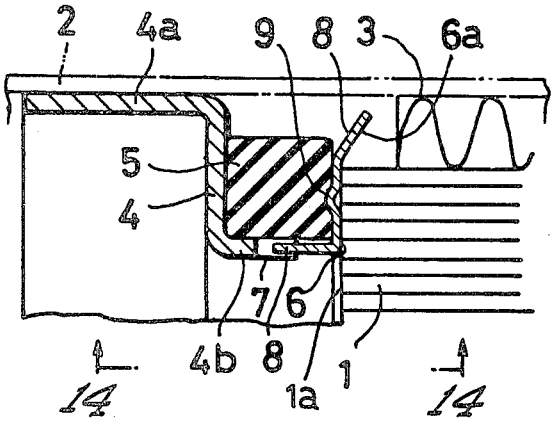
FIG. 13 is a sectional elevation similar to FIG. 11, showing another modification.
Figure 14:
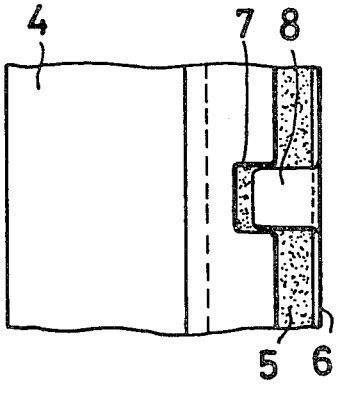
FIG. 14 is an inverted plan view taken substantially on the lines 14—14 as shown in FIG. 13.

FIGS. 13 and 14 illustrate a further embodiment of the invention in which the end member 4 is formed with a z-shaped cross section. The outer axial portion 4*a* of the end member 4 is secured to the casing 2, while the inner axial portion 4*b* supports the annular cushion 5. The inner axial portion 4*b* has its end edge provided with a notch 7. The ring 6 has its inner edge formed with a projection which engages the notch 7 to serve as the locking portion 8.

Figure 15:
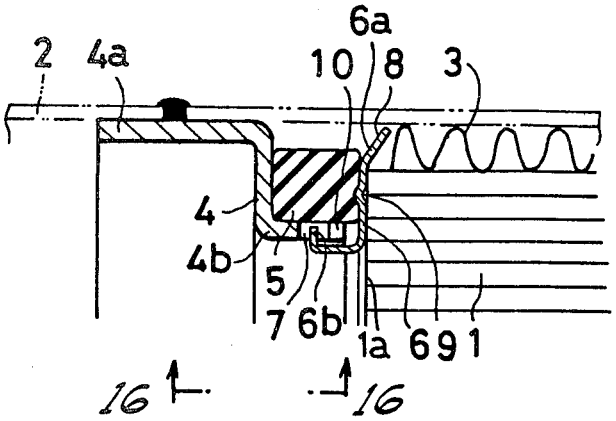
FIG. 15 is a sectional elevation similar to FIG. 13, showing a modification.
Figure 16:
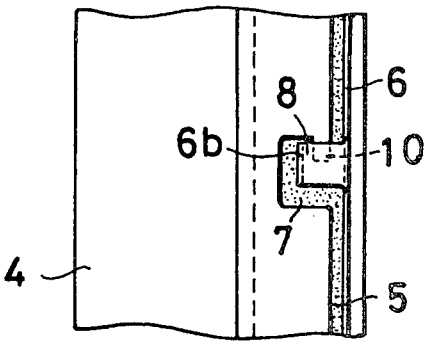
FIG. 16 is an inverted plan view taken substantially on the lines 16—16 as shown in FIG. 15.

FIGS. 15 and 16 illustrate a further embodiment of the invention, which is a variation of the embodiment of FIGS. 13 and 14. The notch 7 is formed like a keyhole serving as the stopper 10. The projecting finger or tab 8 of the ring 6 is formed with a hooked portion 6*b* engaging the stopper 10.

Figure 17:
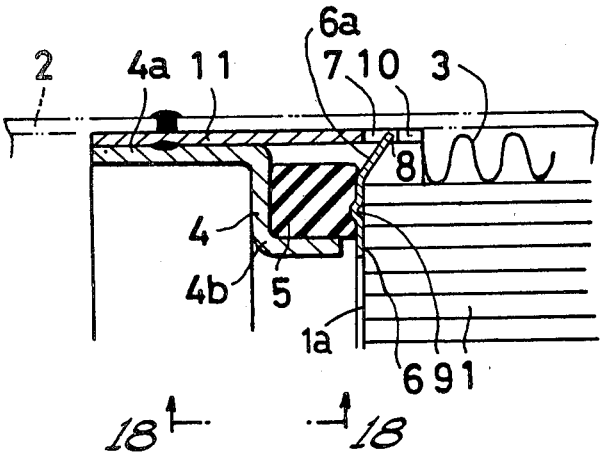
FIG. 17 is a sectional elevation similar to FIG. 15, showing another modification.
Figure 18:
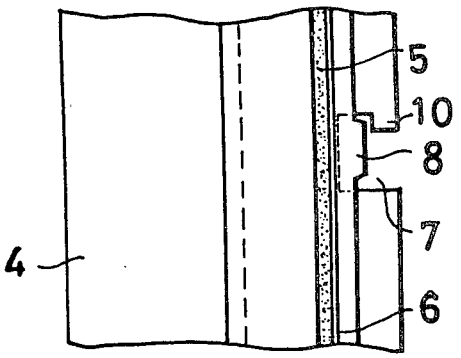
FIG. 18 is an inverted plan view taken substantially on the lines 18—18 as shown in FIG. 17.

FIGS. 17 and 18 show another embodiment of the invention, in which the end member 4, which has a Z-shaped cross section like the corresponding one in FIGS. 13 and 14, is secured to the casing 2 by means of an encircling sleeve 11 fixed to the end member 4 along its outer periphery. The sleeve 11 becomes a part of the end member 4. The notch 7 is formed in the edge of the encircling ring 11. The notch 7, which is in the form of a keyhole, is formed with a projection 10 serving as the stopper.

Figure 19:
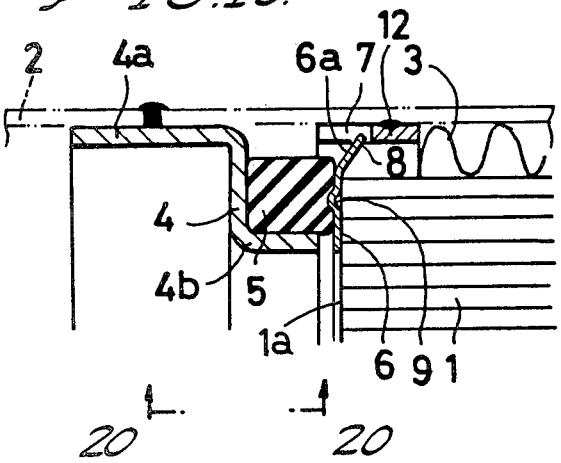
FIG. 19 is a sectional elevation similar to FIG. 17, showing a further modification.
Figure 20:
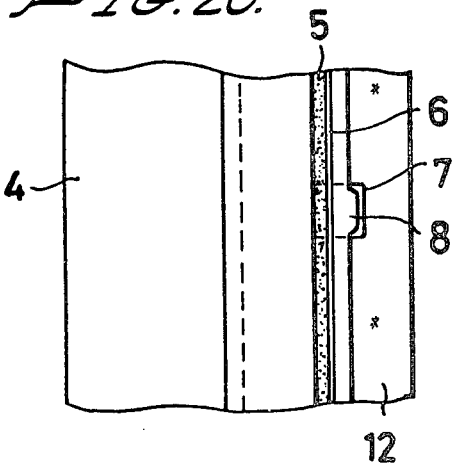
FIG. 20 is an inverted plan view of the device of FIG. 19, taken substantially on the lines 20—20 as shown in FIG. 19.

FIGS. 19 and 20 show a further embodiment of the invention, in which the end member 4 also has a Z-shaped cross section like the corresponding one in FIGS. 13 and 14. A separate sleeve 12 fixed within the casing functions as a part of the end member 4. The notch 7 is provided in the sleeve 12 and is engaged by the finger 8 on the ring 6.

As set forth above, according to the present invention, the ring 6 and a stationary part fixed to the casing 2 are provided with interengaging parts to prevent rotation of the ring 6. The interengaging parts comprise a recess or notch on one part and a projection, tab or finger on the other part. The ring 6 is located in place without rotating and without being strongly urged against the end face 1*a* of the catalyst block 1. The supporting device for the catalyst block is therefore suitable for a long term of use, and also does not require much care in mounting in a place of use.

Having fully described our invention, it is to be understood that we are not to be limited to the details herein set forth but that our invention is of the full scope of the appended claims.

We claim:

1. A device for supporting a cylindrical catalyst block having an end face, comprising in combination: a casing, an axially extending tubular cushion within said casing and encircling the catalyst block, an annular end member fixed within said casing, an annular cushion carried on said end member, a ring member having a frustro-conical peripheral portion, said ring member being interposed between said annular cushion and said end face of said catalyst block, and interengaging parts comprising a projection on said peripheral portion of said ring member received in a recess on said annular end member for preventing rotation of said ring member with respect to said casing.

* * * * *